United States Patent [19]

Hind et al.

[11] 4,129,134

[45] Dec. 12, 1978

[54] SMOKING ARTICLE

[75] Inventors: John D. Hind; William C. Hopkins, both of Richmond, Va.

[73] Assignee: Philip Morris Incorporated, New York, N.Y.

[21] Appl. No.: 686,409

[22] Filed: May 14, 1976

Related U.S. Application Data

[63] Continuation of Ser. No. 567,768, Apr. 14, 1975, abandoned, which is a continuation of Ser. No. 372,488, Jun. 22, 1973, abandoned.

[51] Int. Cl.[2] ..... A24D 1/18

[52] U.S. Cl. ..... 131/2; 131/15 C; 131/140 C

[58] Field of Search ..... 131/140 C, 2, 17, 140 R, 131/15

[56] References Cited

U.S. PATENT DOCUMENTS

| | | | |
|---|---|---|---|
| 3,529,602 | 9/1970 | Hind et al. | 131/2 |
| 3,812,864 | 5/1974 | Cartwright | 131/2 |

FOREIGN PATENT DOCUMENTS

| | | | |
|---|---|---|---|
| 687507 | 3/1967 | Belgium | 131/2 |

*Primary Examiner*—Stephen C. Pellegrino
*Assistant Examiner*—V. Millin
*Attorney, Agent, or Firm*—Watson, Leavenworth, Kelton & Taggart

[57] ABSTRACT

This invention relates to smoking articles, such as cigarettes, little cigars and the like, having a novel wrapper or outer covering and to a method for producing the same. More particularly, the invention relates to smoking articles comprising tobacco and a novel wrapper comprising a film having certain specified properties. The film preferably comprises a natural polysaccharide component which is preferably combined with an alkaline earth metal component. The wrapper possesses a unique appearance and other physical characteristics which are distinct from those of conventional wrappers for tobacco products, such as cigarette papers and tobacco leaves, as well as being distinct from the various modified tobacco products which have been taught as wrappers for smoking products.

5 Claims, No Drawings

SMOKING ARTICLE

This is a continuation of application Ser. No. 567,768, filed Apr. 14, 1975, now abandoned which is a continuation of Ser. No. 372,488 filed June 22, 73 now abandoned.

The wrapper which is employed in accordance with the present invention is particularly unique in a number of ways. For example, it acts to compress the burning or smoldering tobacco coal, thereby reducing the availability of new fuel to the tobacco coal in the interval between puffs. It possesses the ability to shrink at the char line of the smoking product during the pyrolysis of the tobacco and greatly diminishes the production of side stream smoke of smoking articles in which it is incorporated. This feature of the invention thus makes possible a smoking article which produces less smoke when it is not being puffed, for example, when it is left in an ash tray. Furthermore, when the present wrapper has been employed to make smoking products, the resulting products have been found to have improved taste and aroma.

BACKGROUND OF THE INVENTION

Smoking articles, such as cigarettes, cigars and the like have commonly been wrapped in either paper, such as the common cigarette paper, in tobacco leaves, such as cigar wrapper, or in a wrapper formed from what is commonly referred to as reconstituted tobacco. The latter, for example, consists of a modified tobacco composition which is composed of tobacco plant parts in combination with various binders. Such wrappers have been described in U.S. Pat. No. 3,483,874 in the name of one of the present inventors; U.S. Pat. No. 3,125,098 to Osborne; U.S. Pat. Nos. 3,416,537; 3,496,947; and 3,499,453 to Townend and U.S. Pat. Nos. 2,893,400; 2,927,588; and 3,062,688 to Detard.

The present invention embodies a unique wrapper which provides a combination of properties which has not heretofore been obtainable with the wrappers now known in the art and which provides, in a single material, a wrapper for a smoking article having the following advantages and distinctive features:

1. It has a novel appearance and can, if desired, be transparent.
2. It can be made non-porous or with varying degrees of porosity, as desired.
3. When a wrapper which was made in accordance with the present invention was employed in a smoking article, it was found to contribute a very mild flavor to the smoke, when the smoking article embodying it was smoked.
4. When a wrapper which was made in accordance with the present invention was employed in cigarettes, it was found, upon smoking, to be less irritating and to be preferred by most smokers who tested it in comparison with cigarettes having conventional cigarette papers and with little cigars having reconstituted tobacco wrappers.
5. By virtue of its ability to shrink at the char line when smoked, it can greatly reduce the side-stream smoke of tobacco smoking products.
6. It has been found that smoking articles made with wrappers which were prepared in accordance with the present invention had superior shelf life to cigarettes having conventional paper wrappers and did not develop spots, when stored under conditions of relative humidity as high as 85% r.h.

7. As will be set forth later in this specification, certain wrappers of the present invention also have the advantage that they are self-adhesive when moistened with water and, therefore, may not require the application of an adhesive during their fabrication into a smoking product.

DESCRIPTION OF THE INVENTION

The wrapper of the present invention comprises a film which is prepared by casting an aqueous solution, suspension or dispersion of a film-forming ingredient, having certain properties, as described below, under conditions to form a film. Preferably, the film-forming ingredient is a natural polysaccharide. Most preferably, the film-forming ingredient is combined with an alkaline earth metal component.

The natural polysaccharide film-forming ingredient includes natural polysaccharides and natural polysaccharide derivatives and may be a natural polyuronide film-forming material, for example, a pectin or an algin or mixtures of the same or may be a natural galactomannan film-forming material, for example, locust bean gum or guar gum. Other natural polysaccharides which will form satisfactory films include gum Karaya, gum acacia, British gum, agar, starch, carib gum, carrageenin and xanthan. Preferably, the film-forming ingredient is a pectinaceous material or guar gum or a mixture of these two materials. Some of the natural polysaccharide film-forming materials which may be employed in the present wrapper composition are hydrolyzed guar gum, locust bean gum and alginates which, while slightly less preferred than pectin or guar gum, have also been found to provide relatively low levels of pyrolysis flavor. The polysaccharide material, especially the pectinaceous material and/or guar gum, may be employed as the sole film-forming ingredient or may be combined with other film-forming ingredients, as will be described later in this specification. These materials perform extremely well, in accordance with the present invention and contribute a very low horizon or level of flavor to the smoke, when burned. These materials may be obtained from conventional commercial sources or may be prepared by known methods. The pectins may be fruit pectins or vegetable pectins and may be employed as a commercial pectin extracted from a fruit or vegetable or as a pectin-containing fruit component, such as lemon albedo. Pectins having various degrees of methylation may also be employed.

Various other natural polysaccharide film-forming ingredients which contribute low levels of flavor upon pyrolysis may be employed. The natural polyuronide film-forming materials, including the pectins and algins, and the natural galactomannan film-forming materials, including locust bean gum and guar gum, are castable from a water solution or suspension, and most of these are water soluble.

The essence of the present invention is the use of a film-forming ingredient which has the following properties: (1) it will contract along the burning edge of a smoking article employing it; (2) it is non-thermoplastic; and (3) it possesses good elongation properties (at least 1.33%), as measured on a Scott Tester.

Mechanically, all of the above-mentioned materials can be made into films which possess the requisite tensile strength and elasticity, can be slit to tape and used as a wrapper. For the water-resistant films, a suitable adhesive is a water-based paste. For the water-soluble films, which include most of the polysaccharides listed above, with the exception of certain magnesium and calcium alginates or pectates and similar water-insoluble materials, we have found that water alone may be used.

Pectin and guar gum, as mentioned above, have given the best results. All viscosity grades can be used but from the point of view of film quality traded against highest possible solids in film-forming slurries, we have found a medium viscosity grade of pectin or a reduced viscosity grade of guar gum is preferable.

Highly thermoplastic films have been found to be unsatisfactory for use in the present invention, because they make a smoking product, for example, a cigarette, which is "droopy" when it is smoked; such a product also tends to melt and drip at the char line. Hence, commercially available materials which have been recommended for soluble packaging, when tried as wrapper material in the present invention, have not been found to be suitable.

Films made from the natural polysaccharides employed in the present invention are not thermoplastic but tend to become so when very highly plasticized. Thus, as will be set forth later in this specification, while a certain amount of plasticizer may, under some circumstances, be found to be desirable in the present wrappers, the films or wrappers of the present invention should contain no more than 50 parts (by weight) of plasticizing materials, such as humectants or plasticizers, per 100 parts of natural polysaccharide.

The polysaccharide film-forming material, and particularly the pectinaceous material or guar gum, may be used alone or it may be used in combination with an equal amount or less of a second film-forming ingredient. The second film-forming ingredient may, for example, be a natural polysaccharide, such as locust bean gum or certain calcium or magnesium alginates of high purity. When the alginates are employed, they should not be used with calcium carbonate or with large amounts of calcium or magnesium salts, since such use could cause undesirable gelling of the alginates.

The alkaline earth metal component which is preferably employed in the present composition is generally first wet with water to effect dispersion or solution and is then added to the film-forming ingredient. The alkaline earth metal compound or salt is preferably in the form of magnesium or calcium carbonate but may be an inorganic compound such as an oxide, hydroxide, chloride or phosphate of calcium and/or magnesium, for example, water-insoluble minerals, such as calcium and/or magnesium orthophosphates, pyrophosphate, polyphosphates, hydroxy apatites and the like. An advantageous mineral ingredient for applying controlled amounts of calcium is precipitated tricalcium phosphate (NF grade). The alkaline earth metal compound may also be a salt of an organic acid, such as a calcium or magnesium citrate, lactate, maleate or the like. Sodium or potassium salts of these organic acids may also be used as burn additives in addition to the alkaline earth metal salts of such acids. The alkaline earth metal compound, either as a single compound or as a mixture of such compounds, may be employed in an amount corresponding to from 0 to 60 parts (by weight) per 100 parts of natural polysaccharide and is preferably employed in an amount corresponding to from 8 to 40 parts (by weight) per 100 parts of the polysaccharide.

One way of forming a porous wrapper is to produce a gel in the casting slurry, usually by using a combination of algin, or acidic pectin below 70° of methylation and an alkaline earth mineral or hydroxide, and introducing a controlled amount of air just before casting the film. The gel need not be formed this way, however. Any gel, however made in the casting slurry, will serve the desired purpose of holding air bubbles till they break during drying and leave small perforations.

A non-essential, but preferred, ingredient for incorporation in the wrapper of this invention is a plasticizer. The plasticizer is employed to provide the desired processing characteristics for the overall composition and its use depends on the particular film-forming ingredients employed. Suitable plasticizers include certain tobacco extracts, obtained by leaching tobacco parts with water; or with mixtures of solvents such as acetone, methanol, isopropanol with water; or by leaching of tobacco parts in non-aqueous solvents, such as hexane, tetrachloroethylene, ethyl ether and the like. Other plasticizing agents include the monobasic, dibasic and tribasic acids, for example, lactic, malic, tartaric, citric. Additional plasticizers include butylene glycols, sorbitol, sorbitan, sucrose, oligosaccharides, triglyceride fats and oils, long chain fatty alcohols, linear paraffins, normal paraffins, paraffin waxes, beeswax, candelilla wax, carnauba wax and sugar cane wax. When one of these materials is employed, or a combination of these materials is employed, it has been found that the subjective evaluation of the taste and aroma of the smoke resulting from products incorporating the same have been favorable. The plasticizer, when employed, will generally be employed in an amount corresponding to from minute amounts to about 5 parts (by weight) per 100 parts of the film-forming ingredient. Humectants, such as glycerine, monoacetyl glycerol, triethylene glycol, invert sugar and corn syrup, are preferably employed in the composition, in an amount of from about 2 to about 40 parts per 100 parts of film-forming ingredient. However, the total amount of plasticizer and/or humectant employed should not exceed 50 parts (by weight) per 100 parts of the film-forming natural polysaccharide.

Other materials which may be included in the wrapper include nicotine-containing extracts from tobacco leaf and other flavorants which have characteristics to make a desirable smoke. Such flavorants include, for example, licorice, deer tongue, principal oils of rum, chocolate, fruit essence and the like.

When the mixture is to be cast, it can be made into a binder material having a solids content of 5–25%. In this regard, a preferred solids content is the range of 9–15%. If the mixture is to be extruded, a much higher solids content can be used, as high as 80%. For economic reasons, it is desirable to keep the solids content high to prevent having to evaporate great amounts of water per pound of product.

Films produced by the present invention may be cast, dried, cut into strips of suitable width for use as a wrapper in a conventional manner, and fed into a cigarette rod maker in the way that a strip of cigarette paper would be fed. The making of the rod then proceeds in the conventional way except that in most cases the adhesive may be replaced by water, water/alcohol, or lime-water applied in like manner along one edge of the wrapper (usually by a paste wheel or by a felt wick) so that when the edges are overlapped and pressure is applied, by the sealer units, the wrapper is sealed and a finished rod is produced. Heat may not be necessary as it is when using a paper and paste system.

The films will generally be 0.75 to 2.2 mils thick (i.e., true thickness, measured by avoiding irregularities). However, with fiber present, as with citrus albedo, the film may be thicker, e.g., 5 mils. If the transparency is not desired, a white pigment may be added for opaqueness, as for example, titanium dioxide.

Films produced in accordance with this invention should preferably have a shrinkage factor of at least 4%, as determined by placing a measured strip of film of about 1 to 2 mil thickness on a hot plate, placing a screen of about 16 mesh on the film to prevent curling and applying medium temperature, i.e., 350° F. ± 50° F. The film should preferably shrink by at least about 1.0% in length by this method but should preferably not shrink more than about 16.0%.

The following examples are illustrative:

EXAMPLE 1

4.0 grams of citrus pectin, having an acid value of 46 and having a degree of methylation of 62, was dispersed in 95 ml. of water. A dispersion of 0.06 grams of calcium hydroxide in 5 ml. of water was admixed with the pectin dispersion and 1.0 grams of glycerol was added to this combined dispersion. The pH of the resulting dispersion was found to be 7.5.

4.0 grams of "ash-free" carboxymethyl cellulose (CMC) (grade 0.75/3.0) which is the acid form of CMC, was dispersed in 100 ml. of water. The CMC had an acid value of 230 mg./KOH/gram. Pulverized calcium hydroxide in an amount consisting of 0.290 grams, was stirred into 5 ml. of water and the resulting mixture was then stirred into the CMC dispersion. The pH of the resulting dispersion was found to be 8.5.

The two dispersions prepared above were then combined, with vigorous agitation in a Waring blendor. The agitation was continued for a period of about 1 minute, after which a gel, having a pH of 7.5 was formed. The gel was cast on an endless stainless steel belt at room temperature and the resulting film was steam dried. The film which was produced was a clear, strong film having a thickness of slightly over 1 mil and weighed 1.7 ± 0.4 g/sq. ft.

The film was employed as a wrapper for commercial tobacco filler and 10 cigarettes were hand-rolled, employing the film as the sole wrapper material. The cigarette was rolled in the usual way employing water as the adhesive, simply wetting with water the overlapping edges of the film as it was wrapped about the tobacco filler. Experienced cigarette smokers smoked the resulting cigarettes and found the same smoke in the same manner as a conventional paper-wrapped cigarette. They found the cigarettes to be exceptionally mild, with a much enhanced tobacco-like character.

EXAMPLE 2

Dried, extracted lemon albedo (obtained from the Ventura Coastal Lemon Company, Ventura, California) was cooked for 1 hour at a temperature of 80°-90° C. in water containing sufficient hydrochloric acid to maintain a pH of the mixture of 1.5-2.0. Approximately 20 parts of water per part of the lemon albedo, on a weight basis were employed. The resulting slurry, which comprised liberated soluble pectin material having an acid number of 40-60 and a degree of methylation of 60-80% and fibrous material, then had added to it sufficient potassium hydroxide to bring the pH of the resulting mixture to approximately 11.0. The mixture was then allowed to stand at ambient temperature for approximately 30 minutes, at which point the pH of the mixture had dropped to 9.0 and remained at that level. 200 grams of the resulting slurry, having a pH of 9.0 was then placed in a Waring blendor and agitated for a period of 15 minutes. 1.5 grams (10% excess) of calcium chloride, in the form of a 10% aqueous solution, was then added to the mixture in the blendor and the resulting dispersion was then agitated for a period of 15 minutes at room temperature. The resulting calcium pectate-pulp mixture, which was found to have a pH of 8-9, was then pressed in a cake to remove excess water and was washed in a mixture of equal parts acetone and water by volume and the wash liquid, containing excess salts, was removed. The resulting material was then dried to a fine white powder.

One part of the white powder produced above, which was substantially a neutral mixture of calcium pectate and hemi-cellulose pulp, was then re-slurried in approximately 20 parts of water and was combined with 0.2 part of ammonium carbonate, 0.2 part of ammonium citrate, 0.015 part of potassium citrate and 0.1 part of calcium carbonate. The resulting mixture was agitated for a period of 15 minutes to form a gel, which has a pH of 9 and was then cast on an endless stainless steel belt at a setting of 30-50 mils wet thickness to provide a clear, strong film approximately 3 to 5 mils in thickness weighing 4-6 grams per square foot.

The film was employed as a wrapper for commercial tobacco filler and 50 cigarettes were hand-rolled, employing the film as the sole wrapper material. Experienced cigarette smokers smoked the resulting cigarettes and found the same smoke in the same manner as a conventional paper-wrapped cigarette. They found the cigarettes to be exceptionally mild, with a much enhanced tobacco-like character.

EXAMPLE 3

The following ingredients were employed to produce a film:

| | | |
|---|---|---|
| "High Viscosity" Methylated Pectin (Atlantic Gelatin Co., Woburn, Mass., having a degree of methylation of 62, i.e. 62 DM HV) and derived from citrus fruit | | 1.0 part |
| Magnesium Hydroxide ($Mg(OH)_2$) N.F. Fisher Scientific Co. #M-42 | | 0.05 part |
| Glycerol | | 0.30 part |
| Water | | 16.5 parts |
| Isopropanol | | 0.8 part |
| Oven Solids* | About | 6.4 % |

*Oven solids are defined as: residue after drying the slurry for one hour at 100° C.

The ingredients were combined in two ways as follows:

1. About ⅔ of the water and all of the glycerol were placed in a Waring blendor which was set for moderate shear. Pectin was sifted fairly rapidly into the vortex. The magnesium hydroxide (previously dispersed in the balance of the water) was added after a few moments.
2. The glycerol was dissolved in the isopropyl alcohol and the pectin was added to form a creamy slurry. The magnesium hydroxide was dispersed in most of the water. This suspension was dumped suddenly into the pectin slurry (all at once) so as to create violent agitation and dispersion, and mixing was continued with a large spoon or paddle. A little more water was added to reduce the viscosity.

In either case, the solutions were aged for 18 hours (overnight) before remixing and casting films.

The resulting gel was cast in an endless stainless steel belt and resulted in a film which, when equilibrated at 75° F. and 65% r.h., had a thickness of approximately 1.7 mils and which weighed 3.0 grams per square foot, when cast at a Gardner "knife" setting of 25 mils.

The film was employed as a wrapper for commercial tobacco filler and 10 cigarettes were hand-rolled, employing the film as the sole wrapper material. The film was adhered to itself by (employing water as the adhesive) simply wetting with water the overlapping edges of the film as it was wrapped about the tobacco filler and applying pressure in a conventional manner. Experienced cigarette smokers smoked the resulting cigarettes and found the same smoke in the same manner as a conventional paper-wrapped cigarette. They found the cigarettes to be exceptionally mild, with a much enhanced tobacco-like character.

EXAMPLES 4–18

The following films were made by dispersing the indicated polysaccharide in about 200 parts of water, into which the powdered alkaline earth had been dispersed and the required humectant had been dissolved. Alternatively, while stirring the mixture in a Waring blendor for about 0.5–1.0 minute, the humectant was first dispersed and mixed into the dry polysaccharide and then casting the partially gelled product at about 25 mils thickness, drying and slitting the film to suitable widths for cigarette making. In all of these examples, when pectin was used, it was a 62 degree of methylation grade having a medium viscosity (i.e. about 300 cps by the standard Atlantic Gelatin Co. method). The films were tested for tensile strength and for % elongation, employing the following equipment: Scott Serigraph. For each example, certain remarks are made with regard to the nature of the film and/or the nature of the product when smoked.

In each case, the film was employed as a wrapper for commercial tobacco filler and 5 to 20 cigarettes were hand-rolled, employing the film as the sole wrapper material. The film was adhered to itself (employing water as the adhesive) by simply wetting with water the overlapping edges of the film as it was wrapped about the tobacco filler and applying pressure and heat in a conventional manner. Experienced cigarette smokers smoked the resulting cigarettes and found the same smoke in the same manner as a conventional paper-wrapped cigarette. They found the cigarettes to be exceptionally mild, with a much enhanced tobacco-like character.

Table I

Formulations for Smoking Product Wrapper

| Ex. | Ingredients | Tensile** Strength kg/in. | Tensile** Elongation % | Remarks |
|---|---|---|---|---|
| 4 | 10 g. pectin<br>3 g. glycerol<br>0.180 g. $Ca(OH)_2$ | | | About 50% of the pectin acidity was neutralized. Mild smoke, no unusual contribution to natural flavor |
| 5 | 10 g. pectin<br>3 g. glycerol<br>0.540 g. $Ca(OH)_2$ | | | 50% excess calcium hydroxide Smoke as above |
| 6 | 8 g. pectin<br>2 g. alginic acid<br>3 g. glycerol<br>0.5 g. $Mg(OH)_2$ | 831.5 | 1.33 | Smoke flavor slightly different from all-pectin, equally mild |
| 7 | 10 g. pectin<br>1.5 g. glycerol | 791.5 | 1.33 | |

Table I-continued

Formulations for Smoking Product Wrapper

| Ex. | Ingredients | Tensile** Strength kg/in. | Tensile** Elongation % | Remarks |
|---|---|---|---|---|
| | 0.5 g. $Mg(OH)_2$<br>1.5 g. Ca $CO_3$* | | | |
| 8 | 10 g. pectin<br>1.5 g. glycerol<br>2.0 g. Ca $CO_3$ | 912.7 | 1.73 | |
| 9 | 10 g. pectin<br>1.5 g. monoacetin<br>2.0 g. Ca $cO_3$ | 869.9 | 2.00 | |

EXAMPLE 22

Dried, extracted lemon albedo, 5.0 grams, was dispersed in 70 ml. of cold water containing 0.8 gram of citric acid. Addition of 0.2 gram of concentrated HCl brought the pH to 1.5 to 2. The mixture was soaked 30 minutes, refined by "Waring" blendor, and cooled. A mixture of 0.6 gram triethylene glycol, 0.4 gram potassium citrate and 0.1 gram potassium sorbate dissolved in 5 to 10 ml. of water was added to the albedo composition in the blendor; the pH was adjusted to about 6.1 by addition of about 1.3 grams of concentrated aqueous ammonia. The addition of 1.5 grams powdered calcium carbonate gave a dispersion with pH 7.0 to 7.5.

When this was blended at high speed before casting, and the resulting film was dried, the product was very thin and contained many pinhole-like marks which proved under microscope to be merely exceptionally thin spots possibly caused by bubbles. Cigarettes were made with this film as wrapper, sealed by wetting. When the cigarettes were smoked, they burned statically much as would conventional paper-wrapped cigarettes, with a narrow char line staying behind the coal and the wrapper having less tendency to collapse at this line than the film from preceding examples. The result was a somewhat more reliable smolder or static burn for this product, with ventilation occurring behind the coal. The wrapper also had a slightly more papery feel. The ash appeared like that of a cigar, compact and cohesive.

While the inventors do not wish to be bound by any particular theory, it is postulated that the wrapper's reduced tendency to collapse and its lower flexibility or limpness are traceable to a non-thermoplastic contribution from cellulose fiber and hemicellulose components of the albedo.

EXAMPLE 23

A slurry was prepared from the following ingredients:

600 g. 62 DM pectin
240 g. triethylene glycol
150 g. $CaCO_3$
30 g. $Mg(OH)_2$
12 l water, and the pectin was dry-mixed with the triethylene glycol to form a loose mass which was then rapidly dispersed, by means of a high-speed mixer, in water containing the mineral ingredients. About 14 liters of slurry were produced containing about one liter of air, which was held quite firmly because of a slightly gelled condition of the slurry.

The slurry was cast on a stainless steel belt (at 20 mil wet thickness), operated at 7 ft. per minute and heated by hot water at 175° F., 180° F. and 205° F. in three heating zones to produce a film. The dry film weighed 3.1 g. per sq. ft., was 2.5 mils thick, and had a porosity of 4.0 seconds Greiner porosity time.*

* The porosity instrument measures the time required to draw 50 cc of air through 0.786 sq. in. of paper or film. It is made by the Greiner Scientific Co.

In subsequent experiments, air was removed from part of the slurry, and by remixing this with untreated slurry in larger and larger increments, the Greiner porosity "time" was increased in several stages from 13 to 75 seconds.

What is claimed is:

1. A smoking article comprising tobacco parts and/or parts of a tobacco substitute and a wrapper comprising a film having as its main ingredient a natural polysaccharide selected from the group consisting of methylated pectins, guar gum, hydrolyzed guar gum and locust bean gum and mixtures thereof, said wrapper comprising, in addition to said main ingredient, from about 8 to about 40 parts, by weight, per 100 parts of said main ingredient, of an alkaline earth metal compound selected from the group consisting of calcium salts, magnesium salts and mixtures thereof, said wrapper also containing from about 2 to about 40 parts, by weight, per 100 parts of said main ingredient, of a humectant, said wrapper further having a heat shrinkage of greater than about 1% and less than about 16% and containing substantially no tobacco plant parts.

2. The smoking article of claim 1 wherein said natural polysaccharide is combined with from 8 to 40 parts, by weight, per 100 parts of polysaccharide, of an alkaline earth metal compound, selected from the group consisting of calcium carbonate, magnesium carbonate, calcium hydroxide, magnesium hydroxide and mixtures thereof.

3. The smoking article of claim 2 wherein said natural polysaccharide is hydrolyzed guar gum.

4. The smoking article of claim 2 wherein said natural polysaccharide is a citrus pectin.

5. The smoking article of claim 1 wherein said humectant is selected from the group consisting of glycerine, monoacetyl glycerol, triethylene glycol, invert sugar, corn syrup and mixtures thereof.

* * * * *

UNITED STATES PATENT AND TRADEMARK OFFICE

CERTIFICATE OF CORRECTION

PATENT NO. : 4,129,134

DATED : December 12, 1978

INVENTOR(S) : John D. Hind, William C. Hopkins

It is certified that error appears in the above-identified patent and that said Letters Patent are hereby corrected as shown below:

At Col. 8, line 13, the following should be inserted:

| | | | | |
|---|---|---|---|---|
| 10 | 5.0 g. pectin<br>5.0 g. "Methocel" 90 HG (Methylated cellulose)<br>3.0 g. glycerol<br>0.110 g. $Mg(OH)_2$<br>2.0 g. $Ca\ CO_3$ | 480.5 | 4.13 | Different, slightly unnatural note added to smoke flavor |
| 11 | 8.0 g. pectin<br>2.0 g. "Methocel" 90HG<br>175 mg. $Mg(OH)_2$<br>2.0 g. $Ca\ CO_3$<br>3.0 g. glycerol | 495.7 | 2.07 | Difference in smoke flavor less pronounced |
| 12 | 10 g. pectin<br>4 g. monoacetin<br>2 g. $Ca\ CO_3$<br>0.5 g. $Mg(OH)_2$ | 480.9 | 2.00 | |
| 13 | 10 g. pectin<br>2 g. $MgCO_3$<br>0.5 g. sorbitol | 491.1 | 2.00 | |

UNITED STATES PATENT AND TRADEMARK OFFICE

CERTIFICATE OF CORRECTION

PATENT NO. : 4,129,134

DATED : December 12, 1978

INVENTOR(S) : John D. Hind, William C. Hopkins

It is certified that error appears in the above-identified patent and that said Letters Patent are hereby corrected as shown below:

| | | | |
|---|---|---|---|
| 14 | 10 g. pectin<br>0.5 g. sorbitol<br>0.22 g. $Mg(OH)_2$<br>1.78 g. $Ca\ CO_3$ | 600.9 | 1.40 |
| 15 | 10 g. pectin<br>0.5 g. glycerol<br>2.5 sorbitol<br>0.22 g. $Mg(OH)_2$<br>1.78 $MgCO_3$ | 651.2 | 1.60 |
| 16 | 10 g. pectin<br>3 g. propylene glycol<br>0.22 g. $Mg(OH)_2$<br>1.78 g. $Ca\ CO_3$ | 697.1 | 2.07 |
| 17 | 10 g. pectin<br>3 g. triethylene glycol<br>0.22 g. $Mg(OH)_2$<br>1.78 g. $CaCO_3$ | 650.0 | 1.33 |
| 18 | 10 g. low viscosity guar gum***<br>2 g. triethylene glycol<br>1.6 g. $Mg(OH)_2$ | 730.0 | 6.3 |

UNITED STATES PATENT AND TRADEMARK OFFICE

CERTIFICATE OF CORRECTION

PATENT NO. : 4,129,134

DATED : December 12, 1978

INVENTOR(S) : John D. Hind, William C. Hopkins

It is certified that error appears in the above-identified patent and that said Letters Patent are hereby corrected as shown below:

| | | |
|---|---|---|
| 19 | 10 g. low viscosity guar gum<br>2 g. U.S.P. precipitated $CaCO_3$<br>1 g. glycerine | 502.0 2.3 |
| 20 | 10 g. low viscosity guar gum<br>2 g. $CaCO_3$<br>1 g. $Mg(OH)_2$<br>1 g. glycerine | 470.0 3.4 |
| 21 | 10 g. low viscosity guar gum<br>1 g. glycerine | good good |

* Grade (#C-105) prepared by the Sylacauga Calcium Products Co., Sylacauga, Alabama

** Tensile data were measured on a Scott IP-2 (Serigraph), Scott Testers, Inc., Providence, R.I.

*** One way of making low viscosity guar gum (i.e. comparable in viscosity to medium grade 62 DM pectin) is to heat the gum in a closed container with 0.7% HCl (by weight) for from 1/2 to 2 hours. See R. L. Whistler, Ed., Industrial Gums, Academic Press, N.Y. 1959, pages 321-41.

Signed and Sealed this

First Day of May 1979

[SEAL]

Attest:

RUTH C. MASON
Attesting Officer

DONALD W. BANNER
Commissioner of Patents and Trademarks